US005658205A

United States Patent [19]

Bartscherer

[11] Patent Number: 5,658,205

[45] Date of Patent: Aug. 19, 1997

[54] GOLF CLUB HEAD ALIGNING AID

[76] Inventor: Ted L. Bartscherer, 3605 San Pasqual St., Pasadena, Calif. 91107

[21] Appl. No.: 587,950

[22] Filed: Jan. 17, 1996

[51] Int. Cl.[6] ..... A63B 69/36

[52] U.S. Cl. ..... 473/238; 473/228; 40/334; 40/360; 40/915; 273/DIG. 30

[58] Field of Search ..... 473/228, 238; 40/334, 360, 915; 273/DIG. 30

[56] References Cited

U.S. PATENT DOCUMENTS

| | | | |
|---|---|---|---|
| 2,771,678 | 11/1956 | Hansen, Sr. . | |
| 2,898,109 | 8/1959 | Williams . | |
| 3,253,829 | 5/1966 | Ford . | |
| 3,262,705 | 7/1966 | Nunziato . | |
| 3,951,415 | 4/1976 | Stuart | 473/238 |
| 4,040,631 | 8/1977 | Flippin . | |
| 4,167,268 | 9/1979 | Lorang . | |
| 4,204,332 | 5/1980 | Gray . | |
| 4,257,607 | 3/1981 | Nedwick . | |
| 4,306,721 | 12/1981 | Doyle | 473/238 |
| 4,789,158 | 12/1988 | Chiesa . | |
| 4,949,971 | 8/1990 | Thornton . | |
| 5,143,376 | 9/1992 | Johnson . | |
| 5,152,533 | 10/1992 | Radakovich . | |
| 5,181,723 | 1/1993 | Brown | 273/DIG. 30 |
| 5,207,174 | 5/1993 | Fabbrini | 40/334 X |
| 5,228,695 | 7/1993 | Meyer | 473/238 |
| 5,294,126 | 3/1994 | Armstrong, III . | |
| 5,310,188 | 5/1994 | Hernberg . | |

*Primary Examiner*—George J. Marlo
*Attorney, Agent, or Firm*—Denton L. Anderson; Sheldon & Mak, Inc.

[57] ABSTRACT

A golf club aligning aid is provided which allows a golfer to quickly improve his or her golf swing. The aligning aid can be a small strip of flexible material which can be disposed with a planar "flag" portion which is disposed perpendicular to the shaft of the club. This planar portion can be rotated about the shaft for proper alignment with respect to the leading edge of the face of the golf club head. Preferably, the aligning aid is attached on or near the handle of the club by being snugly wrapped around the shaft and attached to itself, such as by a hook and loop fastener. In one embodiment, the aligning aid also has a graphical design disposed on one end of the planar portion. The graphical design has a first axis which, when the aid is attached to the clubs is perpendicular to the shaft of the golf club and a second axis designed to be disposed parallel to the shaft of the club. The ratio of the length of the second axis to the length of the first axis is between about 0.25 and about 0.75. Such a graphical design assists the golfer in properly positioning the aid when the head of the club is at the top of his or her backswing.

20 Claims, 3 Drawing Sheets

GOLF CLUB HEAD ALIGNING AID

FIELD OF THE INVENTION

The present invention relates to golfing aids and instructional devices, and specifically, to golfing aids for properly aligning the head of a golf club at the top of the golfer's backswing.

BACKGROUND

Since the beginning of golfing history, one of the most basic problems facing the golf enthusiast is how to properly position the golf club head at the top of the golfer's backswing so that, at the bottom of the swing, the head of the club meets the ball squarely. Every golfer quickly learns that if the face of the head square is with the ball at the moment of contact, the ball will fly straight and true. However, if the face of the head is slightly turned to one side or the other, the ball will hook to one side or slice to the other.

Unfortunately, it is almost impossible to see the club head at the top of the golfer's backswing. Even where the head can be seen at the top of the backswing, it is difficult to interpret whether or not the face of the head is in a correct position—so that, at the bottom of the downward arc of the golf swing, the face of the head strikes the ball squarely.

A number of golfing aids have been considered in the past to assist the golfer with this problem. Unfortunately, none of these golfing aids have been wholly satisfactory. All of them have suffered from one or more of the following disadvantages: (1) being so heavy as to alter the "feel" of the club, (2) being too large so as to aerodynamically affect the "feel" of the club during the golf club swing, (3) being mechanically difficult to install and de-install from the club, and/or (4) being unduly expensive.

Accordingly, there is a need for an inexpensive golf club head aligning aid which is lightweight and will not aerodynamically affect the feel of the golf club during the swing and which is simple and easy to use without tools.

SUMMARY

The invention satisfies these needs. The invention is a golf club aligning aid comprising (a) a planar, flat directional indicator having a first end and a second end; and (b) attachment means for attaching the second end of the directional indicator to the shaft of a golf club such that the directional indicator is disposed in a plane parallel to the longitudinal axis of the golf club shaft, and such that the first axis of the graphical design is substantially perpendicular to the longitudinal axis of the golf club shaft.

Preferably the aligning aid has a weight less than about 8 grams, has a length between about 13 centimeters and about 19 centimeters and has a width between about 4 centimeters and about 7 centimeters. The golfing aid of the invention is preferably made from a flexible material having a density less than about 0.2 gm/cm$^3$.

In one embodiment, the aid further comprises a graphical design disposed on the first end of the directional indicator. The graphical design has a first axis and a second axis, the first axis being perpendicular to, and longer than, the second axis. It is preferred that the ratio of the second graphical design access to the first graphical design axis is between about 0.25 and about 0.75, most preferably between about 0.4 and about 0.6. The graphical design can have any of a large number of shapes, including ovals, rectangles, diamonds and other suitable polyhedrons. Preferably, the design is symmetrical with respect to its longitudinal axis and with respect to its transverse axis.

Also it is preferable that the aid be readily attachable and de-attachable without tools. In a preferred embodiment, the aid is simply wrapped snugly around the shaft of the club and fastened to itself, such as by a hook and loop fastener.

The golfer uses the aid by always attaching the aid at the same angle with respect to the leading edge of the face of the club head. Preferably, the aid is attached on or near the handle of the club head. The golfer then practices his or her golf swing, each time viewing the disposition of the golf club aid when the head of the club is at the top of the swing. Although the golfer cannot easily see the golf club head at the top of the swing, he or she can see the golf club aid. By repeatedly practicing his or her stroke after observing the disposition of the golf club aid, the golfer quickly learns the correct disposition of the golf club aid when the club head is in the proper position at the top of the backswing.

In embodiments having the above mentioned graphical design, this learning effort is made easier by preadjusting the disposition of the aligning aid so that, when the aid is in the proper disposition with the club head at the top of the swing, the aid is cocked with respect to the golfers line of sight at an angle which provides the illusion that the length of the first axis of the graphical design is approximately the same as the length of the second axis.

The aligning aid of the invention provides a simple and inexpensive way for golfers to quickly improve the consistency of their golf club swings. The aligning aid of the invention is simple and inexpensive to use, requires no tools and does not affect the "feel" of the club during use.

DESCRIPTION OF THE DRAWINGS

These and other features, aspects and advantages of the present invention will become better understood with reference to the following description, appended claims and accompanying drawings where:

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Figure 1:
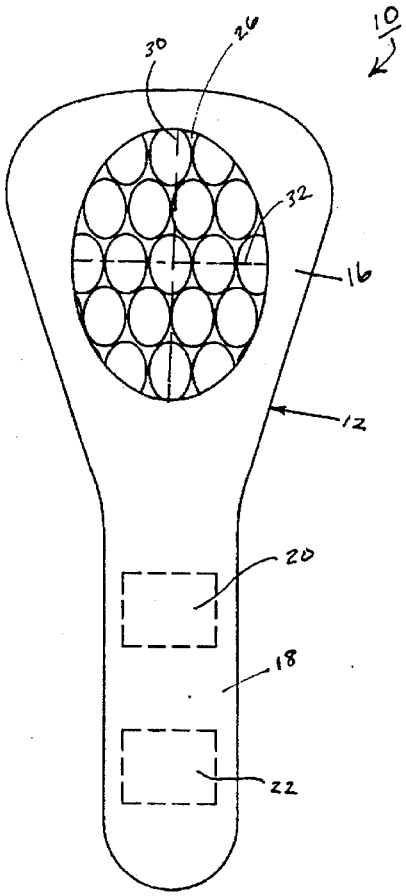
FIG. 1 is a top view of a golfing aid having features of the invention.
Figure 2A:
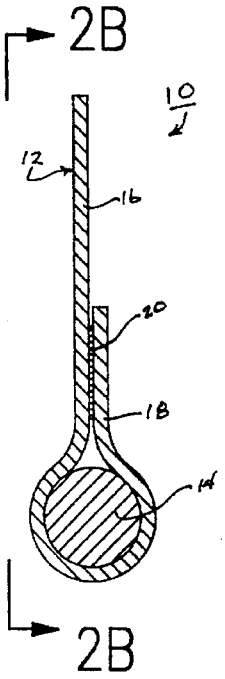
FIG. 2A is a cross-sectional side view of the golfing aid of FIG. 1 as that aid would look when wrapped around the shaft of a golf club.
Figure 2B:
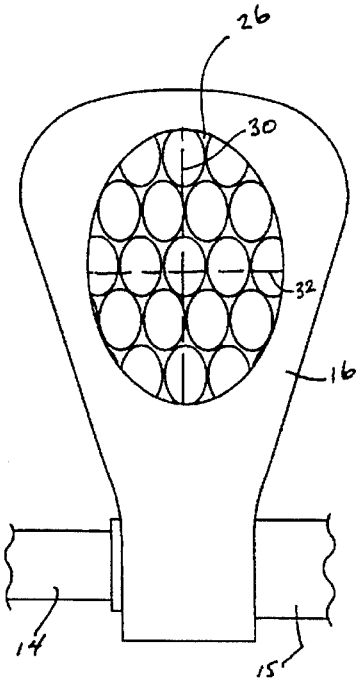
FIG. 2B is a top view of the golfing aid shown in FIG. 2A.

As shown in FIGS. 1, 2A and 2B, the invention is a golf club head aligning aid 10 comprising a directional indicator 12 and attachment means for attaching the directional indicator to a golf club shaft 14 or grip 15.

The directional indicator 12 is a planar, flat section of material having a first end 16 and a second end 18. It is important that the size, shape and weight of the directional indicator 12 is chosen so that the aligning aid 10 cannot be "felt" by the golfer during the golfer's swing. Accordingly, the total weight of the aligning aid 10 is preferably less than about 15 gm, most preferably less than about 8 gm. In a typical embodiment, the aligning aid 10 has a length between about 13 cm and about 19 cm and a width of the first end 16 between about 4 cm and about 7 cm. It is also preferable that the density of the aligning aid 10 be less than about 0.2 g/cm$^3$, most preferably less than about 0.05 g/cm$^3$.

The inventor has found that the aligning aid can be conveniently made from a cross-linked polyurethane or other similar material.

The first end 16 of the directional indicator 12 should be of sufficient size to be readily observed by the golfer when the golfer holds a golf club at the top of the backswing, but not so large as to be perceptible by the golfer during the swing itself. In this regard, the overall area of the first end 16 of the directional indicator 12 can be between about 10 cm$^2$ and about 35 cm$^2$, preferably between about 15 cm$^2$ and about 25 cm$^2$.

It is also important that the directional indicator 12 be sufficiently rigid to retain its planar, flat form prior to the golf swing, but be sufficiently flexible to allow it to bend away from the resistance of the atmosphere during the golf swing. Such flexibility minimizes aerodynamic drag resulting from use of the aligning aid 10 and allows for the golfer to use the aligning aid 10 without its use altering in any way the "feel" of the swing.

It is also important that the attachment means allow the aligning aid 10 to be readily attached and deattached from the golf club without use of tools.

As shown in the embodiments illustrated in the drawings, the second end 18 of the directional indicator 12 is preferably sufficiently flexible, and has sufficient coefficient of friction, to be snuggly and securely wrapped around the shaft 14 or grip 15 of the golf club. In such embodiments, the attachment means can be any of the many commonly used attaching devices, such as hook and loop fasteners, snaps, hooks, buttons, clips, tabs, pins, clamps and clasps. Preferably, for ease of attachment, detachment and adjustment, the attachment means is a hook and loop fastener such as those sold under the VELCRO® trademark. As shown on the embodiments in the drawings, the hook and loop fastener 20 is conveniently attached to the underside of the second end of the aligning aid. The hook moiety 22 of the fastener is spaced apart from the loop moiety 24 of the fastener by a sufficient distance to allow the second end 18 of the directional indicator 12 to be wrapped tightly around the shaft 14 or grip 15 of a typical golf club.

In embodiments as shown in the drawings wherein the aligning aid 10 is attached to the golf club by wrapping the second end 18 around the golf club shaft 14 or grip 15, it is important that the aligning aid 10 be made from or comprise a material having sufficient coefficient of friction that the aligning aid does not slip with regard to the golf club shaft 14 or grip 15 during use.

In addition to the directional indicator 12 and the attachment means, the aligning aid 10 of the invention can comprise a graphical design 26 disposed on the first end 16 of the directional indicator 12. Such graphical design 26 assists the user in seeing the directional indicator 12 and properly interpreting the angle at which the directional indicator 12 is disposed when the club head 28 is at the top of the backswing.

To further assist the user in interpreting the proper disposition of the directional indicator 12 when the club head 28 is at the top of the backswing, the graphical design 26 can be created so that, when the user looks at the directional indicator 12 when the golf head 28 is at the top of the backswing, the graphical design 26 is perceived differently in different dispositions. In the embodiments shown in the drawings, this is accomplished by providing a graphical design 26 having certain particular characteristics. The graphical design 26 has a first axis 30 and a second axis 32. The first axis 30 is defined as that axis which is generally perpendicular to the golf club shaft 14 when the aligning aid 10 is attached to the golf club shaft 14 or grip 15. The second axis 32 is defined as that axis which is generally parallel to the golf club shaft 14 when the aligning aid 10 is attached to the golf club shaft 14 or grip 15. In the embodiments shown in the drawings, the length of the first graphical design axis 30 is longer than the length of the second graphical design axis 32. The ratio of the length of the second graphical design axis 32 to the length of the first graphical design axis 30 is typically between about 0.25 and about 0.75 and is preferably between about 0.4 and about 0.6.

Graphical designs 26 as described immediately above are necessarily elongate. However, when such graphical designs 26 are disposed at an angle with respect to the line of sight of the observer, such that one end of the first axis 30 of the graphical design 26 is further away from the eye of the observer than is the opposite end of the first axis 30 of the graphical design 26, the graphical design 26 provides the illusion of being generally less oblong. In fact, when the graphical design 26 is disposed at a particular angle with respect to the line of sight of the observer, the graphical design 26 appears to lose its "oblongness" altogether. For example, where the graphical design 26 is an oval with the first axis 30 of the oval disposed in the vertical and second axis 32 of the oval disposed in the horizontal, tilting the top of the graphical design 26 backwards away from the observer will provide the illusional to the observer that oval becomes increasingly circular. As the top of the graphical design 26 is tilted continually backwards, at some point, the graphical design 26 will appear perfectly circular to the observer.

Figure 3A:
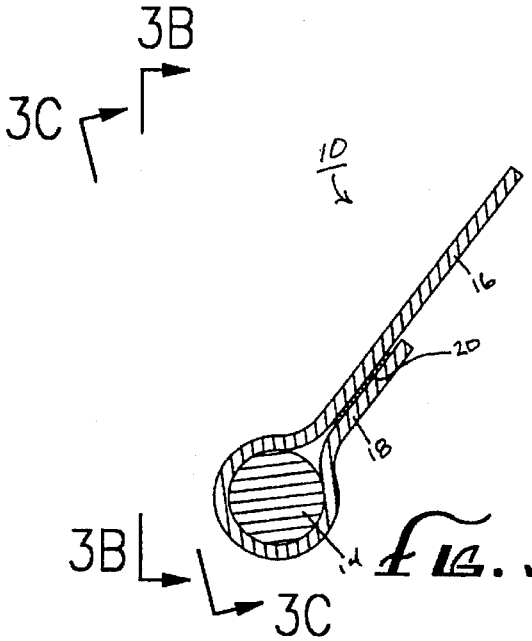
FIG. 3A is a cross-sectional side view of the golfing aid of FIG. 1 as that aid would look when wrapped around the shaft of a golf club—as in FIG. 2A, but now shown disposed at an angle with respect to the vertical.
Figure 3B:
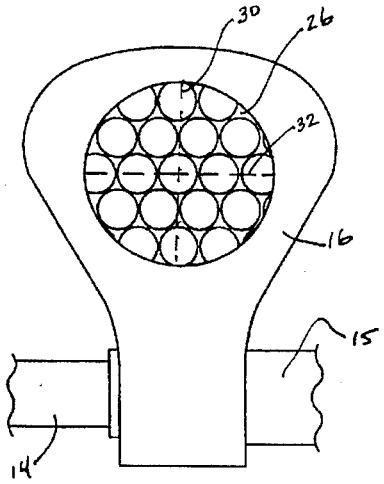
FIG. 3B is a top view of the golfing aid of FIG. 3A.
Figure 3C:
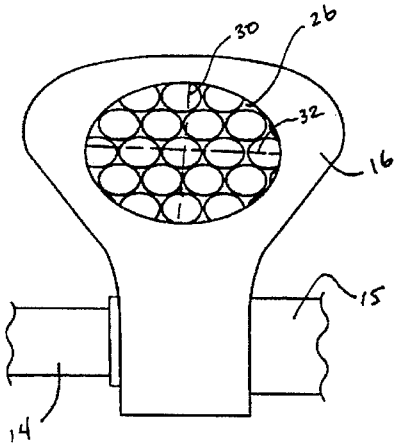
FIG. 3C is a top view of the golfing aid of FIG. 3A when the golfing aid shown in FIG. 3A is further rotated clockwise so as to be disposed closer to the horizontal than when shown in FIG. 3B.

This phenomenon is illustrated in FIGS. 2A, 2B, 3A, 3B and 3C. In FIGS. 2A and 2B, the graphical design 26 is disposed in the vertical. In such disposition, the perimeter of the graphical design 26 appears to be oval-shaped and the interior of the graphical design 26 appears to be filled with a plurality of small ovals. However, when the aligning aid 10 is rotated away from the observer as shown in FIGS. 3A, 3B and 3C, the graphical design 26 appears progressively less oval in shape, until at some point, it appears to be relatively circular (as shown in FIG. 3B). At this point, the interior of the graphical design 26 appears to the observer to be filled with a plurality of circles, instead of ovals (i.e., the graphical design 26 looks like a rendition of a golf ball). As the graphical design 26 is further rotated away from the eye of the observer, as shown in FIG. 3C, the second axis 32 of the graphical design 26 actually appears to be of greater length than the first axis 30. In other words, the graphical design 26 again appears to be oblong, but now oblong with respect to left and right, as opposed to oblong with respect to up and down.

By experimenting with aligning aids 10 having differing graphical design axis ratios, the individual golfer can find an aligning aid 10 whose graphical design 26 appears to lose its "oblongness" when the aligning aid 10 is at the precisely correct angle for him or her—the angle which properly aligns the golf club head 28 at the top of the golfer's backswing.

Typically the graphical design 26 is symmetrical with respect to both the first axis 30 and the second axis, although this is not necessary. The graphical design 26 can be symmetrical with respect to either the first axis 30 or the second axis 32 or neither.

Figure 4A:
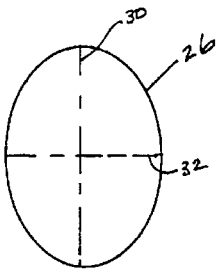
FIG. 4A is a graphical design useful in the invention.
Figure 4B:
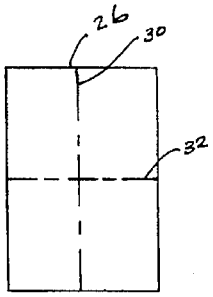
FIG. 4B is a graphical design useful in the invention.
Figure 4C:
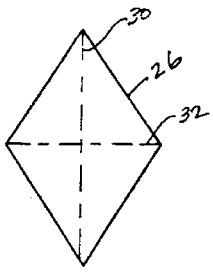
FIG. 4C is a graphical design useful in the invention.
Figure 4D:
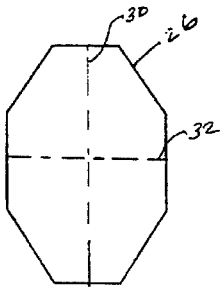
FIG. 4D is a graphical design useful in the invention.
Figure 4E:
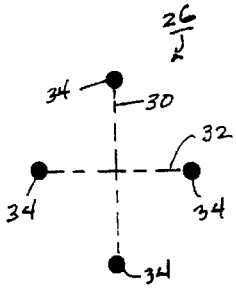
FIG. 4E is a graphical design useful in the invention.
Figure 4F:
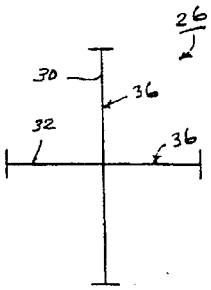
FIG. 4F is a graphical design useful in the invention.
Figure 6:
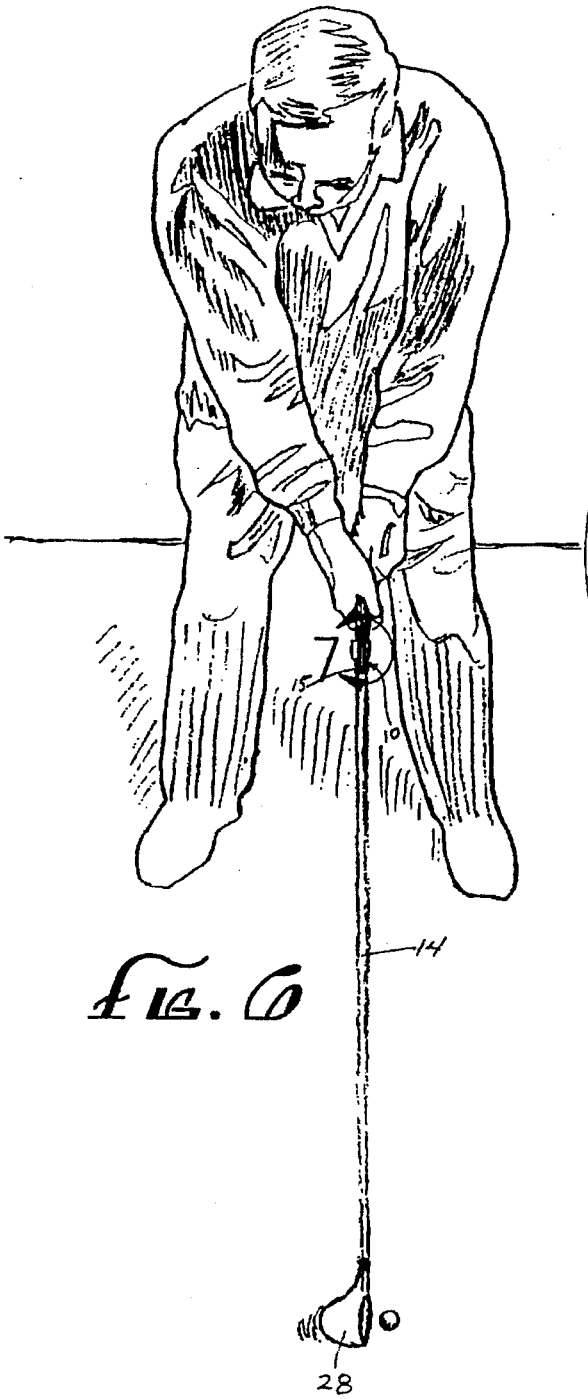
FIG. 6 is a front view of a golfer using a golf aid having features of the invention.
Figure 7:
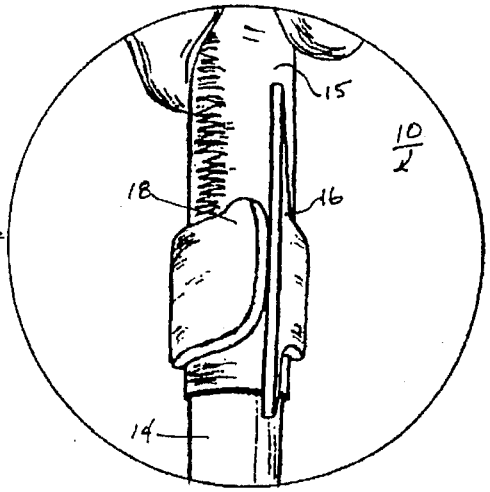
FIG. 7 is a detail view of the golfing aid shown in FIG. 6.
Figure 8:
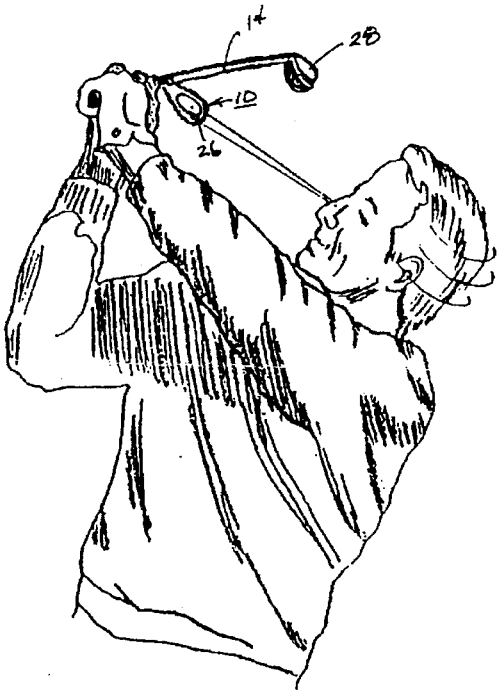
FIG. 8 is a side view of a golfer using a golfing aid having features of the invention with the golf club at the top of the backswing.

As shown in FIGS. 4A–4D, typical examples of graphical designs 26 useful in the invention are ovals, rectangles, diamonds, hexagons, and other polyhedrons. The graphical designs 26 can also be made up from a limited number of points 34, such as shown in FIG. 4E, or can be made up of two axis lines 36, as shown in FIG. 4F.

Figure 5:
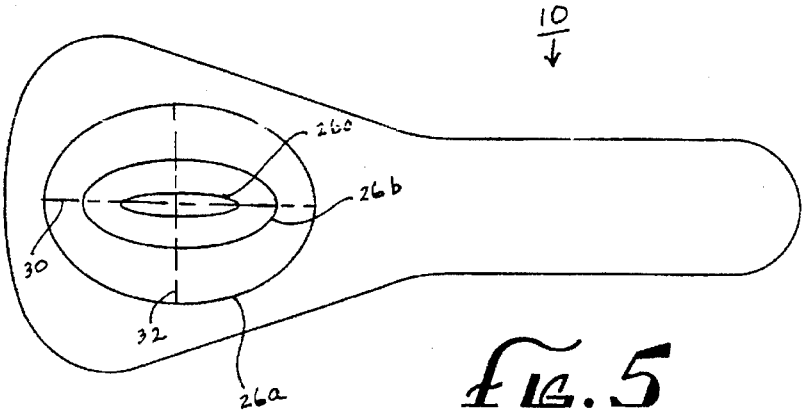
FIG. 5 is a top view of another golfing aid having features of the invention, including three different graphical designs, each having different axis ratios.

The aligning aid 10 can also comprise several different graphical designs 26, each having a different graphical design axis ratio. FIG. 5 illustrates such an aligning aid having three different oval-shaped graphical designs 26*a*, 26*b* and 26*c*, each having a different graphical design axis ratio.

In operation, the golfer uses the aligning aid 10 by always attaching the aid 10 at the same angle with respect to the leading edge of the face of the club head 28. Preferably, the aid 10 is attached on or near the handle 38 of the club. The golfer then practices his or her golf swing, each time viewing the disposition of the aligning aid 10 when the head of the club 28 is at the top of the backswing. Although the golfer cannot easily see the golf club head 28 at the top of the backswing, he or she can see the aligning aid 10. By repeatedly practicing his or her stroke after observing the disposition of the aligning aid 10, the golfer quickly learns the correct disposition of the aligning aid 10 when the club head 28 is in the proper position at the top of the backswing.

In embodiments having the above described graphical design 26, this learning effort is made easier by preadjusting the disposition of the aligning aid 10 so that, when the aid 10 is in the proper disposition with the club head 28 at the top of the backswing, the aid 10 is cocked with respect to the golfers line of sight at an angle which provides the illusion that the length of the first axis 30 of the graphical design 26 is approximately the same as the length of the second axis 32.

The aligning aid 10 of the invention can be used with all golf clubs, and can be used for practicing all of the different kinds of golf strokes. In addition to practicing strokes which will drive the ball in a straight line, the golfer can also use the aligning aid 10 to practice various golf strokes intended to impart a certain lateral movement to the ball, such as controlled hooks, draws, slices and fades.

The aligning aid of the invention provides a simple and inexpensive way for golfers to quickly improve the quality and consistency of their golf swings. The aligning aid of the invention can be quickly and easily attached and aligned on the golf club without tools. The aligning aid provides the golfer with a unique tool for "observing" the alignment of the head of his or her golf club at the top of the backswing, without affecting in any way the "feel" of the club, either during the backswing or during the forward swing of the club.

What is claimed is:

1. A golf club head aligning aid for use with a golf club having a golf club head attached to one end of a golf club shaft, the golf club shaft being elongate with a longitudinal axis, the aligning aid comprising:

(a) a planar directional indicator having a first end and a second end;

(b) a graphical design disposed on the first end of the directional indicator, the graphical design being symmetrical with respect to a first axis and with respect to a second axis, the first axis being perpendicular to, and longer than, the second axis; and (c) attachment means for attaching the second end of the directional indicator to the shaft of a golf club such that the directional indicator can be disposed in a plane parallel to the longitudinal axis of the golf club shaft, and such that the first axis of the graphical design can be substantially perpendicular to the longitudinal axis of the golf club shaft.

2. The golf club head aligning aid of claim 1 wherein the ratio of the length of the second graphical design axis to the length of the first graphical design axis is between about 0.25 and about 0.75.

3. The golf club head aligning aid of claim 1 wherein the ratio of the length of the second graphical design axis to the length of the first graphical design axis is between about 0.40 and about 0.60.

4. The golf club head aligning aid of claim 1 wherein there is disposed on the first end of the directional indicator (1) a first graphical design which is symmetrical with respect to a first axis and with respect to a second axis, the first axis being perpendicular to, and longer than, the second axis and (2) a second graphical design which is symmetrical with respect to a first axis and with respect to a second axis, the first axis being perpendicular to, and longer than, the second axis, wherein the ratio of the length of the second axis of the first graphical design to the length of the first axis of the first graphical design is different than the ratio of the length of the second axis of the second graphical design to the length of the first axis of the second graphical design, and wherein both ratios are between about 0.25 and about 0.75.

5. The golf club head aligning aid of claim 1 wherein the weight of the aligning aid is less than about 8 gm.

6. The golf club head aligning aid of claim 1 wherein the aligning aid has a length and a width, the length being between about 13 cm and about 19 cm.

7. The golf club head aligning aid of claim 1 wherein the first end of the aligning aid has a length and a width, the width being between about 4 cm and about 7 cm.

8. The golf club head aligning aid of claim 1 wherein the aligning aid is made in substantial part from a flexible material having a density of less than about 0.2 g/cm$^3$.

9. The golf club head aligning aid of claim 1 wherein the aligning aid is made in substantial part from a cross-linked polyurethane material having a density of less than about 0.05 g/cm$^3$.

10. The golf club head aligning aid of claim 1 wherein the attachment means allows the user to conveniently attach and deattach the alignment aid to a golf club shaft without use of tools.

11. The golf club head aligning aid of claim 1 wherein the second end of the alignment aid is capable of being wrapped snuggly and in nonslip fashion around the golf club shaft or grip and wherein the attachment means comprises means for attaching the terminus of the second end of the alignment aid to a portion of the second end of the alignment aid located distal from such terminus.

12. The golf club head aligning aid of claim 1 wherein the attachment means comprises an attachment device selected from the list of attachment devices consisting of hook and loop fasteners, snaps, hooks, buttons, clips, tabs, pins, clamps and clasps.

13. The golf club head aligning aid of claim 1 wherein the attachment means comprises a hook and loop fastener.

14. A golf club head aligning aid for use with a golf club having a golf club head attached to one end of a golf club shaft, the golf club shaft being elongate with a longitudinal axis, the aligning aid comprising:

(a) a planar directional indicator having a first end and a second end;

(b) a graphical design disposed on the first end of the directional indicator, the graphical design having a first axis and a second axis, the first axis being perpendicular to, and longer than, the second axis; and (c) attachment means for attaching the second end of the directional indicator to the shaft of a golf club such that the directional indicator is disposed in a plane parallel to the longitudinal axis of the golf club shaft, and such that the first axis of the graphical design is substantially perpendicular to the longitudinal axis of the golf club shaft; wherein;

(1) the ratio of the length of the second graphical design axis to the length of the first graphical design axis is between about 0.25 and about 0.75;

(2) the graphical design is symmetrical with respect to the first axis and with respect to the second axis;

(3) the aligning aid has a length and a width, the length being between about 13 cm and about 19 cm; and (4) the first end of the aligning aid has a length and a width, the width being between about 4 cm and about 7 cm.

15. The golf club head aligning aid of claim 14 wherein the second end of the alignment aid is capable of being wrapped snuggly and in nonslip fashion around the golf club shaft and wherein the attachment means comprises hook and loop means for attaching the terminus of the second end of the alignment aid to a portion of the second end of the alignment aid located distal from such terminus.

16. A golf club comprising:

(a) a golf club shaft having a first shaft moiety and a second shaft moiety the first shaft moiety terminating in a first shaft end and the second shaft moiety terminating in a second shaft end the golf club shaft being elongate and having a longitudinal axis;

(b) a golf club head attached to the first shaft end; and (c) a golf club head aligning aid attached to the second shaft moiety, the golf club head aligning aid comprising:

(i) a planar directional indicator having a first end and a second end;

(ii) a graphical design disposed on the first end of the directional indicator, the graphical design bring symmetrical with respect to a first axis and with respect to a second axis, the first axis being perpendicular to, and longer than, the second axis; and (iii) attachment means for attaching the second end of the directional indicator to the shaft of a golf club such that the directional indicator is disposed in a plane parallel to the longitudinal axis of the golf club shaft, and such that the first axis of the graphical design is substantially perpendicular to the longitudinal axis of the golf club shaft.

17. The golf club of claim 16 wherein a gripping handle is disposed around the second shaft moiety and the golf club head aligning aid is attached to the gripping handle.

18. The golf club of claim 16 wherein the attachment means comprises an attachment device selected from the list of attachment devices consisting of hook and loop fasteners, snaps, hooks, buttons, clips, tabs, pins, clamps and clasps.

19. A method for practicing a golf swing wherein the golf swing comprises a back swing moiety and a forward swing moiety and wherein the golf club has (i) a golf club shaft with a first shaft moiety and a second shaft moiety, the first shaft moiety terminating in a first shaft end and the second shaft moiety terminating in a second shaft end, the golf club shaft being elongate and having a longitudinal axis and (ii) a golf club head attached to the first shaft end, the method comprising the steps of:

(a) attaching a golf club head aligning aid to the second shaft moiety, the golf club head aligning aid comprising:

(i) a planar directional indicator having a first end and a second end;

(ii) a graphical design disposed on the first end of the directional indicator, the graphical design being symmetrical with respect to a first axis and with respect to a second axis, the first axis being perpendicular to, and longer than, the second axis; and (iii) attachment means for attaching the second end of the directional indicator to the shaft of a golf club;

the golf club head aligning aid being attached to the second shaft moiety such that the directional indicator is disposed in a plane parallel to the longitudinal axis of the golf club shaft, and such that the first axis of the graphical design is substantially perpendicular to the longitudinal axis of the golf club shaft;

(b) adjusting the golf club head aligning aid so that, when the golfer holds the golf club at the top of the back swing with the face of the golf club head disposed at a predetermined angle with respect to the ground, the golfer is able to observe the golf club head aligning aid and, in that position, the first axis of the graphical design appears to the golfer to have the same length as the second axis;

(c) executing the back swing moiety of the golf swing and then pausing with the golf club at the top of the back swing;

(d) rotating the golf club shaft about its longitudinal axis until the first axis of the graphical design on the golf club head aligning aid appears to the golfer to have the same length as the second axis; and (e) executing the forward swing moiety of the golf swing.

20. The method of claim 19 wherein the golf club further comprises a gripping handle around the second shaft moiety and wherein the golf club aligning aid is attached to the gripping handle in step (a).

* * * * *